United States Patent [19]

Sindel

[11] Patent Number: 4,850,328

[45] Date of Patent: Jul. 25, 1989

[54] AIR GUN

[75] Inventor: Gerhard Sindel, Ansbach, Fed. Rep. of Germany

[73] Assignee: Fritz Barthelmes KG, Fed. Rep. of Germany

[21] Appl. No.: 57,009

[22] Filed: Jun. 1, 1987

[51] Int. Cl.[4] ..... F41B 11/00; F41D 10/12; F41C 25/06

[52] U.S. Cl. ..... 124/67; 124/66; 124/41 R; 124/52; 124/82; 124/85; 124/51 R

[58] Field of Search ..... 124/41 C, 41 R, 52, 124/53, 51 R, 45, 63–67, 82, 85

[56] References Cited

U.S. PATENT DOCUMENTS

| | | | |
|---|---|---|---|
| 107,442 | 9/1870 | Buckman et al. | 124/52 X |
| 461,224 | 10/1891 | Stanly | 124/67 |
| 1,245,499 | 11/1917 | Orme | 124/52 X |
| 1,509,257 | 9/1924 | Randall | 124/67 |
| 1,677,810 | 7/1928 | Bond | 124/51 R |
| 1,766,179 | 6/1930 | Lefever | 124/67 |
| 2,306,668 | 12/1942 | Stevens | 124/67 |
| 2,462,922 | 3/1949 | Temple | 124/66 X |
| 2,737,942 | 3/1956 | Horowitz | 124/82 X |
| 3,111,121 | 11/1963 | Baggott | 124/67 |
| 3,818,887 | 6/1974 | Akiyama et al. | 124/53 X |

FOREIGN PATENT DOCUMENTS

| | | | |
|---|---|---|---|
| 471596 | 2/1929 | Fed. Rep. of Germany | 124/67 |
| 1905216 | 2/1969 | Fed. Rep. of Germany . | |
| 1966147 | 3/1972 | Fed. Rep. of Germany | 124/67 |
| 2053107 | 5/1973 | Fed. Rep. of Germany | 124/51 |
| 2326317 | 5/1973 | Fed. Rep. of Germany . | |
| 3040924 | 10/1980 | Fed. Rep. of Germany . | |
| 1250763 | 9/1987 | Fed. Rep. of Germany | 124/67 |
| 1144653 | 10/1957 | France | 124/66 |
| 365548 | 3/1973 | U.S.S.R. | 124/67 |

*Primary Examiner*—Randolph A. Reese
*Assistant Examiner*—John A. Ricci
*Attorney, Agent, or Firm*—Davis, Bujold & Streck

[57] ABSTRACT

An air gun, especially an air pistol, with a piston (2) movable in a weapon housing in a pressure chamber and adapted to be brought to a cocking position against a spring pressure by a cocking arrangement (7, 8, 9) that engages said piston (2). The barrel (6) has a rear barrel opening (5) in which is insertable an elongated profiled bullet (4). In the weapon housing is situated a bullet magazine (16) for several consecutively arranged bullets (4), the inner space (17) of the bullet magazine is at least approximately adapted to the profile of the bullets and the bullets are prestressed in the direction toward the barrel opening (5) via a feed device (19, 20). In the upper area of the bullet magazine (15) there are situated, at least approximately at the height of the rear barrel opening (5), a discharge opening (24) before the barrel opening and a plunger opening (25) opposite to said discharge opening (24), a plunger (15) for inserting the bullet that is first in the barrel opening (5) being movable from behind through the plunger opening (25) and at least partly through the discharge opening (24).

7 Claims, 1 Drawing Sheet

AIR GUN

The invention concerns an air gun, especially an air pistol, having a piston movable in a pressure chamber in the gun housing, which piston can be brought into a cocked position against a spring pressure by a rod that acts upon said piston, and having a barrel with a rear barrel opening into which is insertable the elongated profiled bullet.

To fire bullets from air guns, it is usual that each time a piston must be prestressed by a spring and each time a bullet must be separately introduced in the barrel opening. After actuating the trigger, the bullet is fired by releasing the prestressed piston by means of compressed air. Then the piston of the air gun must again be cocked and again a new bullet must be inserted in the rear barrel opening.

An elongated profiled bullet is generally used. The bullet here has a substantially cylindrical front part with a frustoconical rear part attached thereto. Forming a recess, the small diameter of the cone is attached to the front part with a transition region starting from the cylindrical shape. Those bullets are generally known by the name of Diabolo. They serve especially as competition bullets.

This invention is based on the problem of providing an air gun of the above mentioned kind that can be more easily used, especially that needs not be recharged after each shot.

According to the invention this problem is solved by the fact that a bullet magazine for several consecutively arranged bullets is situated in the gun housing, the inner space of the bullet magazine being adapted, at least approximately, to the profile of the bullets. The bullets are prestressed via a feeding device in the direction toward the barrel opening and in the upper area of the bullet magazine there are situated, at least approximately at the height of the rear barrel opening, a discharge opening in front of the barrel opening and a plunger opening opposite to said discharge opening, a plunger being movable for inserting the first bullet into the barrel opening from behind through the plunger opening and at least partly through the discharge opening.

According to the invention, it is no longer necessary to load bullets individually for each shot; on the contrary, a large number of bullets can be shot depending on the size of the bullet magazine for each loading of the magazine. It is only required that the piston of the air gun be cocked in the usual manner.

Although bullet magazines are used in conventional weapons, their application to air guns had not hitherto been considered practical. On the one hand, the particular shape of the bullet was a problem and on the other hand, a simple adoption of the principle used in conventional weapons would not have been possible. Thus, for instance, the plunger for inserting the bullet that is first or uppermost in the rear barrel opening was not compatible with a firing pin.

Although it is likewise known already that in annual-fair air rifles the weapon has a magazine for simple round bullets, this again is a different system.

The barrel opening, the discharge opening, the plunger opening and the plunger are in general situated in one plane which results in a movement that is rectilinear and thus simple to perform.

The bullet magazine itself can be situated in any desired place in the weapon. This depends on the kind of weapon involved. Most usual is an arrangement in the handle of the weapon. This specially applies to an air pistol in the design according to the invention.

A very advantageous and not obvious embodiment of the invention consists in that the plunger is connected with the rod for cocking the piston.

To feed the bullet that is uppermost or first into the rear barrel opening, different designs and devices can be provided. But in a connection with the rods for cocking the piston, it is possible automatically to obtain without special effort, together with the cocking of the piston, a feeding of the uppermost or first bullet in the rear barrel opening.

The connection with the rods can be in any manner desired. A possible solution consists in hinging a rocking lever on the plunger, the other end of which engages the piston driving rod.

However, depending on the configuration of the cocking device for the piston, there can be conceived a different kind of connection that is within the scope of the invention.

In order that the uppermost or first bullet can be perfectly guided, it can be provided that there be arranged in the area of the uppermost or first bullet, instead of the adaptation of the profile of the bullets, a spring-like device. Said spring-like device simultaneously serves to ensure that the uppermost bullet does not slip out when the magazine is not in the weapon.

The spring-like device can be comprised of two flat springs situated opposite to each other at the sides of the bullet mazazine.

The plunger will be advantageously provided with a recess or at least a flattening extending in the longitudinal direction of the bullet magazine.

By virtue of this configuration it is possible when the weapon is cocked and the plunger is inserted to remove the magazine providing it is correspondingly open ended.

A possible feeding device can consist in providing against the lowermost or last bullet a pressure member that is under the prestressing of a spring that supports itself in the bullet magazine or in a part of the weapon housing.

At the same time it can be provided that the pressure member having an operating pin that projects from a slot of the bullet magazine and an opening for inserting bullets be situated laterally in the lower area of the bullet magazine.

Within the scope of the invention there can be provided even another possibility of recharging such as from the top into the bullet magazine as will be apparent to a man skilled in the art.

An embodiment of the invention is explained in principle herebelow with reference, by way of example, to the drawings, in which.

Figure 3:
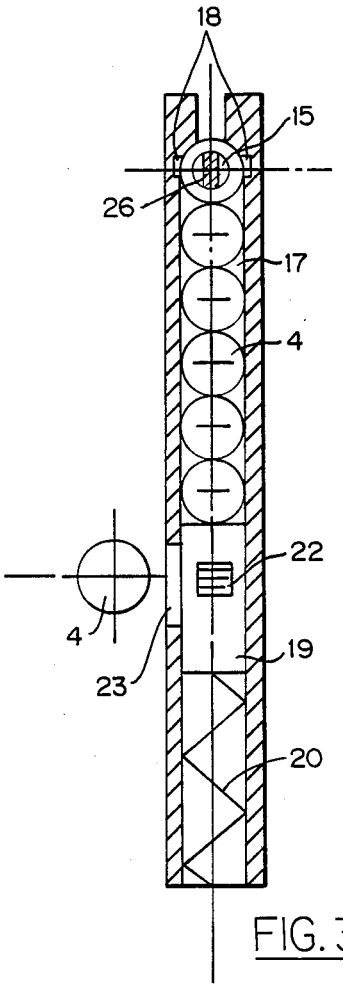
FIG. 3 shows a section along line III—III of FIG. 2.
Figure 2:
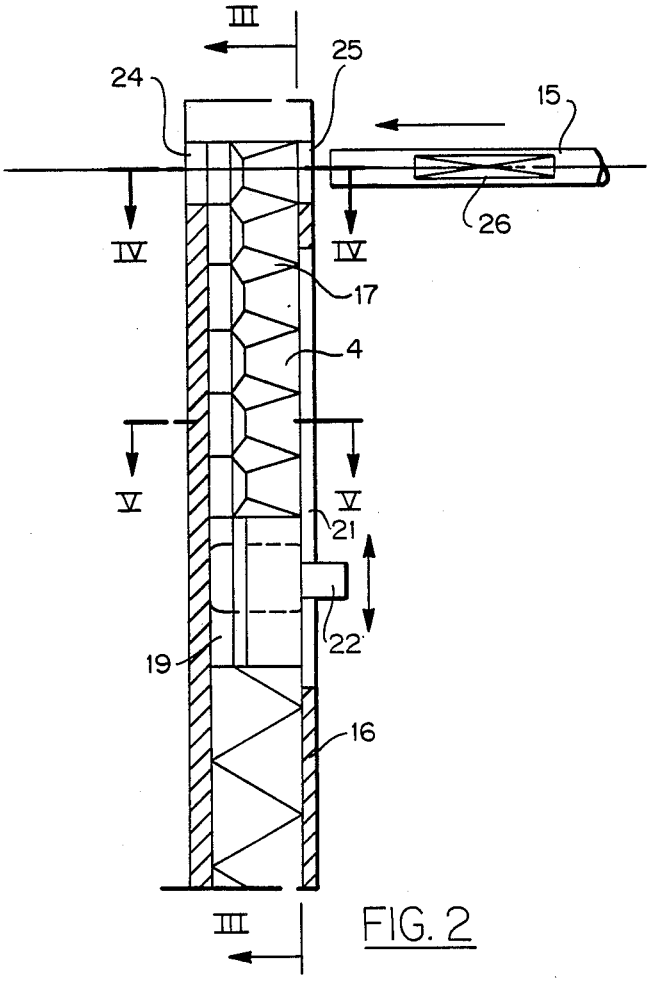
FIG. 2 shows an enlarged longitudinal section through the magazine according to the invention.

The air gun (shown generally at G in the diagramatic representation of FIG. 1) which can be provided with the bullet magazine according to the invention, can be basically of a known structure. For this reason it is not described in detail herebelow. Only the cocking device with the connection with the bullet magazine according to the invention is shown in principle in FIG. 1.

The air gun has a pressure cylinder 1 with a piston 2 prestressed by a spring 3. In the illustration the spring 3, shown as compression spring, is in its cocked position and a bullet 4 is in a rear barrel opening 5 of a barrel 6.

The rod for cocking the piston 2 has a piston driving rod 7 that performs a linear motion, a connecting lever 8 and a pivotable lever 9.

When actuating the trigger arm (not shown), the prestressed piston 2 is released whereby it is moved entirely to the right, that is, to practically the right end (FIG. 1) of the pressure cylinder 1. Here the bullet 4 is shot from the barrel 6 by the surge of compressed air. If the pivotable lever 9 is now upwardly pivoted, the piston 2 is again pushed to the left into the cocked position via a drag stud 10 connected with the piston 2 and a stop 11 of the driving rod 7, and latched there until it is again released by a new actuation of the trigger arm. It will be appreciated that lever 8 is oppositely angled at the beginning of the cocking stroke.

Figure 1:
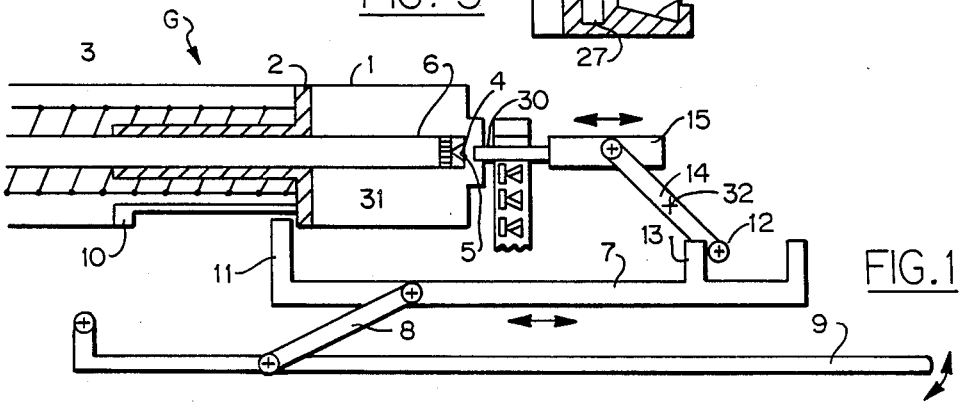
FIG. 1 shows a diagramatic representation of the piston of an air gun with the cocking device and a part of the magazine according to the invention.

A rocking lever 14 is connected with the piston driving rod via a hinged connection 12 and a stud 13 situated on the piston lever 7. The other end of the driving rod 14 is hinged on a plunger 15. The lever 14 is pivotally and fixedly connected to the gun intermediate the ends at 32, as can be seen in FIG. 1. As a result of this connection, the plunger 15 is moved back and forth in a linear motion when the piston is cocked via the tipping lever 9.

The plunger 15 is drawn out from the magazine to the right (FIG. 1) when the weapon is cocked. A bullet 4 is then upwardly pressed by pressure member 19 under the bias of a spring 20. When the tipping lever 9 is returned to the idle position (as shown), the plunger 15 pushes the bullet 4 into the barrel opening 5. A sealing ring 30 slipped between the rear end of the pressure cylinder 1 and the bullet magazine 16 via the forward end of the plunger 15 prevents compressed air in pressure chamber 31 from escaping when the bullet is freed upon firing.

Instead of a tipping lever 9, another configuration of the cocking lever such as by a lateral spring tension is also possible within the scope of the invention. In this case only the hinged connection has to be given an accordingly different shape.

The function and manner of operation of the air gun according to the invention can be clearly seen in FIGS. 2 to 5.

Several bullets 4 are consecutively arranged in a bullet magazine 16. The bullet magazine 16 can be situated, for instance, in the butt of the air gun.

Figure 4:
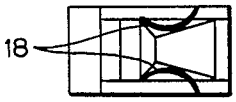
FIG. 4 shows a section along line IV—IV of FIG. 2.
Figure 5:
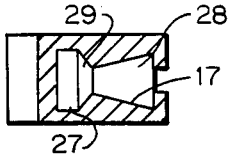
FIG. 5 shows a section along line V—V of FIG. 2.

As it can be understood from FIGS. 4 and 5, the inner space 17 of the bullet magazine possesses a configuration adapted to the profile of the bullets 4. Only in the upper area is a simple rectangular shape selected instead of the adapted shape, and two flat springs 18 situated at the sides of the bullet magazine serve as spring-like device for guiding the uppermost or first bullet 4.

Beneath the lowermost bullet 4 is situated a pressure member 19 that is under the prestressing action of a spring 20 that supports itself on the lower wall of the magazine. But instead of this the spring can also be supported on another part of the weapon housing.

The pressure member 19 has an operating pin 22 projecting from a slot 21 of the bullet magazine. In the bullet magazine 16 there is in the lower area a side opening 23 through which the bullets 4 can be recharged in the magazine. It is only necessary for this to push back the pressure member 19, via the operating pin 22 against the force of the spring 20, sufficiently far down to allow a new bullet to be inserted via the side opening 23.

At the upper end the bullet magazine 16 has a discharge opening 24 opposite the barrel opening 5. A plunger opening 25 is situated in the magazine opposite the discharge opening 24.

As it can be seen, while the piston 2 is cocked, the plunger can thus be pushed from behind by the tipping lever 9 through the plunger opening 25 and through the discharge opening 24, the uppermost of first bullet 4 in the bullet magazine 16 being inserted in the rear barrel opening 5. If the plunger 15 is then again drawn back, the bullet 4 that follows next is automatically brought to the uppermost or first position by the pressure member 19 that is under tension of the spring 20. In this manner, when the piston 2 is next cocked a bullet is again inserted in the same manner in the barrel opening 5.

The area that projects into the bullet magazine 16 when the plunger 15 is pushed has on both sides, that is, in the longitudinal direction of the bullet magazine 16, flat area 26. For a better explanation there is shown in this connection in FIG. 3 the position in which the plunger is in the pushed state to the left relative to FIG. 2. These flats allow springs 18 to close behind the bullet being loaded pending arrival of the next bullet upon removal of the plunger 15.

The bullets 4 have each a profile comprising a substantially cylindrical front part 27 and a frustoconical rear part 28 attached thereto (see FIG. 5). As it can be seen, the rear part 28 is attached to the front part 27 by the smaller diameter of the cone, forming a recess. The front part 27 with its cylindrical shape has for this purpose a transition region 29 in the form of a likewise frustoconical portion.

I claim:

1. An air gun (G) comprising a housing and having a piston (2) movable in a pressure cylinder (1) of the housing, the piston being movable into a cocked position against the pressure of a spring (3) by a driving rod (7, 11) that acts upon said piston, and having a barrel (6) with a rear barrel opening (5) into which is insertable an elongated profiled bullet defining a longitudinal axis, wherein a bullet magazine (16), for carrying several consecutively arranged bullets (4), is situated in said gun, said magazine defining an inner space (17) adapted to the profile of the bullets, the bullets when in the magazine being biased via a feeding device (19, 20) in a direction toward said barrel opening (5), in the area of said magazine (16), at least approximate the location of said rear barrel opening (5), a discharge opening (24) aligned with said barrel opening (5) and a plunger opening (25) opposite to and aligned with said discharge opening (24) are situated, a plunger (15) being movable through said plunger opening (25) and at least partly through said discharge opening (24) for inserting into said barrel opening from behind a bullet in the magazine that is most adjacent said barrel opening (5) wherein said plunger (15) is connected with said driving rod (7, 8, 9) for cocking the gun via a rocking lever (14), wherein one end of said rocking lever is hinged to said plunger (15) and the other end engages said driving rod (7), and said rocking lever (14) being pivotably and fixedly supported (32) intermediate both said ends.

2. An air gun according to claim 1 wherein in said inner space (17) of said bullet magazine (4) there is provided a spring device (18) for guiding said bullets in the portion of said space incorporating the discharge opening (24).

3. An air gun according to claim 2 wherein said spring device has two flat springs (18) situated opposite to each other at the sides of said bullet magazine (16).

4. An air gun according to claim 1 wherein said plunger (15) has two opposed flat areas (26) extending in the longitudinal direction of said bullet magazine (16).

5. An air gun according to claim 1 wherein said feeding device (19, 20) has against a bullet (4) most remote from opening (24) a pressure device (19) that is under the biasing action of a spring (20) that is supported in said gun.

6. An air gun according to claim 5, wherein said pressure member (19) has an operating pin (22) projecting from a slot (21) of said bullet magazine (16) and in the lower area of said bullet magazine (16) there is laterally disposed an opening (23) for inserting bullets (4).

7. An air gun according to claim 1, wherein a sealing ring (30) is situated between the rear end of said pressure cylinder (1) and said bullet magazine (16) to prevent compressed air from escaping the rear end of said pressure cylinder upon firing.

* * * * *